US006158729A

United States Patent [19]

Tsai

[11] Patent Number: 6,158,729

[45] Date of Patent: Dec. 12, 2000

[54] COMPACT, STIFF, REMOTELY-ACTUABLE QUICK-RELEASE CLAMP

[75] Inventor: Ted W. Tsai, Houston, Tex.

[73] Assignee: The United States of America as represented by the Administrator of the National Aeronautics and Space Administration, Washington, D.C.

[21] Appl. No.: 09/208,800

[22] Filed: Nov. 24, 1998

[51] Int. Cl.[7] ..... B25B 5/12

[52] U.S. Cl. ..... 269/228; 269/201; 269/136

[58] Field of Search ..... 269/228, 201, 269/136, 238, 239; 254/15–17

[56] References Cited

U.S. PATENT DOCUMENTS

| | | | |
|---|---|---|---|
| 2,691,201 | 10/1954 | Matthews . | |
| 3,346,929 | 10/1967 | Webb . | |
| 3,564,564 | 2/1971 | Paine . | |
| 3,831,926 | 8/1974 | Sendoykas et al. | 269/228 |
| 3,872,760 | 3/1975 | Desnoyers, Jr. | 269/228 |
| 3,924,844 | 12/1975 | Bachtel, Jr. | 269/228 |
| 3,945,092 | 3/1976 | Andrews . | |
| 4,052,045 | 10/1977 | Shaddix . | |
| 4,854,016 | 8/1989 | Rice . | |
| 5,108,216 | 4/1992 | Geyer et al. . | |
| 5,413,312 | 5/1995 | Bobel | 254/15 |
| 5,527,014 | 6/1996 | Bracewell | 254/15 |
| 5,527,024 | 6/1996 | Dysktra | 269/228 |
| 5,660,372 | 8/1997 | Bobel | 254/15 |
| 5,961,109 | 10/1999 | Dykstra et al. | 269/228 |

*Primary Examiner*—David A. Scherbel
*Assistant Examiner*—Lee Wilson
*Attorney, Agent, or Firm*—James M. Cate

[57] ABSTRACT

The present invention provides a clamp that is compact and lightweight, yet provides high holding strength and stiffness or rigidity. The clamp uses a unique double slant interface design which provides mechanical advantages to resist forces applied to the clamp members as the load increases. The clamp allows for rapid and remote-activated release of the clamp jaws by applying only a small operating force to an over-center lock/release mechanism, such as by pulling a manual tether.

22 Claims, 6 Drawing Sheets

COMPACT, STIFF, REMOTELY-ACTUABLE QUICK-RELEASE CLAMP

ORIGIN OF THE INVENTION

The invention described herein was made by and employee of the United States Government and may be manufactured and used by or for the Government of the United States of America for governmental purposes without the payment of any royalties thereon or thereafter.

FIELD OF THE INVENTION

The present invention relates to a high strength clamp that can be released by hand. More particularly, the present invention relates to a high strength clamp with jaws that can be remotely released and which open widely upon release.

BACKGROUND OF THE RELATED ART

High strength clamps are useful in various industrial applications, typically holding two or more members in place during a procedure of limited duration. For example, a high strength clamp may be used to hold together two structural steel members while the members are welded together. As another example, a high strength clamp may be used to secure heavy equipment to a truck during transport of the equipment from one location to another. As yet another example, a high strength clamp may be used to connect two pipe flanges together while another, more permanent type of fastener is installed or removed, such as bolts, rivets or screws.

One particularly demanding application for high strength clamps is the contingency demating procedure (separation) of aerospace structures, e.g., of the Space Shuttle from either the Russian MIR or the Space Station. This procedure requires a lightweight, high strength and remotely releasable clamping tool for securing the docking module halves of NASA's Orbiter Docking System (ODS) during removal of ninety-six ¼ inch bolts. The docking module halves define a flanged, circumferential interface sealed by two O-rings, highly loaded, therebetween. Typically, two high strength clamps are placed about 180 degrees apart to hold the interfacing flanges together while the bolts holding them are removed by astronauts. The clamps must have sufficient holding strength and rigidity to oppose the seal and external loads, which can exceed about ten-thousand pounds, and thereby assure the integrity of even the final few remaining bolts and prevent any premature or partial separation of the interfacing flanges. After the removal of the bolts, the astronauts can safely execute the separation by releasing the two clamps, preferable by remote activation under an operating force no greater than 25 pounds. It is also preferred that the clamp jaws open at least 90 degrees upon release to clear the working area and allow for an unobstructed separation of the two flanges.

Cross-sectional side views of a prior art toggle action clamp 10, otherwise known as the Orbiter Docking System 96-bolt contingency clamp, are shown in FIGS. 1 and 2 in the open (released) position and the closed (clamped) position, respectively. This clamp uses a conventional over-center toggle action mechanism 12 with an actuating lever 14 for clamping (FIG. 2) and releasing (FIG. 1) the interfacing flanges 16,18. In order to achieve a low operating force, the clamp gains leverage by incorporating the handle 14 having a substantial assembled length of 32 inches. To further lower the operating force required to release the clamp, the over-center toggle is limited to angles less than one degree (<1). The long linkages 20 of this and other toggle-type clamps are inherently less stiff than other clamp designs and do not maximize the stiffness-to-weight ratio. In fact, this clamp design must be enhanced to achieve the high stiffness and strength necessary for this application, and results in each clamp weighing a substantial 22 pounds.

Another disadvantage of the prior art toggle action clamp is its sensitivity to friction occurring within the joints or pivots 22 of the toggle mechanism. As the axial load in the linkages 20 increases, the frictional forces within the joints 22 that oppose rotation of the linkages increase proportionally, as does the operating force required to release the clamp. Polishing the mating surfaces of linkages decreases the amount of the friction in the joints, but when the linkages are under loads of several thousand pounds, the friction is still significant.

Despite attempts to facilitate release of the prior art clamp 10, release of the clamp still requires an excessive force exceeding the standard 25 pound allowable force for manned space operations. Consequently, an additional winch tool (not shown) must be connected to the end 24 of the long handle 14 in order to release the clamp 10 under such a high load. Using a winch tool further complicates the contingency extravehicular operation for demating of the docking system (represented by flanges 16,18). The clamp also requires certain undesirable maintenance procedures, including calibration and pre-flight checkout.

Therefore, there is a need for a high-performance clamp that provides a high holding force, yet requires only a minimal force to release the clamp. It would be desirable if the clamp could be released by hand, preferably with less than 25 pounds of force. It would also be desirable if the clamp could open fully during release to allow easy separation of the clamped objects. It would be further desirable if the clamp were both lightweight and compact. It will be understood by those in the art that such characteristics are of importance and benefit in various ground-based applications of such clamps, in addition to the context of the illustrative aerospace example just described.

SUMMARY OF THE INVENTION

The present invention provides a clamp comprising a first jaw having a workpiece contacting end, a central fulcrum and a cantilever, as well as a second jaw having a workpiece contacting end and a central fulcrum coupled to the central fulcrum of the first jaw. A third member is pivotally coupled to the second jaw so that the third member is disposed to contact the cantilever of the first jaw and maintain the spacing between the first and second jaws. A fourth member, or hook, is disposed between the third member and the cantilever to retain the cantilever in contact with the third member. A locking member, such as an over-center mechanism, may also be provided for releasably securing the hook in contact with the cantilever.

It is preferred that the clamp apply at least a snug down load to a workpiece using a spindle bolt disposed through a jaw to contact the workpiece. It is also preferred that the clamp also comprise an over-center mechanism to engage and retain the fourth member. An optional slide link assembly may be disposed between the third member and the first jaw to allow one hand operation of the clamp.

In accordance with another aspect of the present invention, a clamp, as described above, includes a cantilever having first and second opposed surfaces, wherein the third member is disposed to contact the first opposed surface of the cantilever and the fourth member is disposed to contact the second opposed surface of the cantilever. The slanted surfaces of the third and fourth members may be formed by wedge portions disposed to contact the first and second opposed surfaces, respectively. A locking member may then be incorporated to releasably secure the wedge portion of the fourth member in contact with the second opposed surface.

In yet another aspect of the present invention, the clamp comprises a first jaw having a workpiece contacting end, a central fulcrum and a cantilever having a load transmitting surface, as well as a second jaw having a workpiece contacting end and a central fulcrum coupled to the central fulcrum of the first jaw. A load bearing member is pivotally coupled to the second jaw so that the load bearing member is displaceably disposed to contact the load transmitting surface of the cantilever. A hook, pivotally coupled to the load bearing member, is displaceably disposed to secure the load bearing member in contact with the load transmitting surface. The hook is secured by a locking mechanism pivotally coupled to the load bearing member. Where the locking mechanism is an over-center mechanism, the mechanism comprises a roller which engages a cradle formed in an arm of the load bearing member. A set screw is preferably disposed through the arm for adjusting the over-center angle.

The invention also provides an apparatus comprising a plurality of clamping members. Each clamping member comprises a first jaw having a clamping end, a central fulcrum, and a cantilever; a second jaw having a clamping end and a central fulcrum coupled to the central fulcrum of the first jaw; a third member pivotally coupled to the second jaw, the third member disposed to contact the cantilever of the first jaw; and a hook disposed between the third member and the cantilever to retain the cantilever in contact with the third member; a first workpiece contacting plate coupled to the clamping end of the first jaw of each clamping member; and a second workpiece contacting plate coupled to the clamping end of the second jaw of each clamping member, wherein the central fulcrums of each clamping member have a common axis.

BRIEF DESCRIPTION OF THE DRAWINGS

So that the above recited features and advantages of the present invention can be understood in detail, a more particular description of the invention, briefly summarized above, may best be understood with reference to the embodiments which are illustrated in the appended drawings. It is to be noted, however, that the appended drawings illustrate only typical embodiments of this invention and are therefor not to be considered limiting of its scope, for the invention may admit to other equally effective embodiments.

DETAILED DESCRIPTION OF A PREFERRED EMBODIMENT

Figure 1:
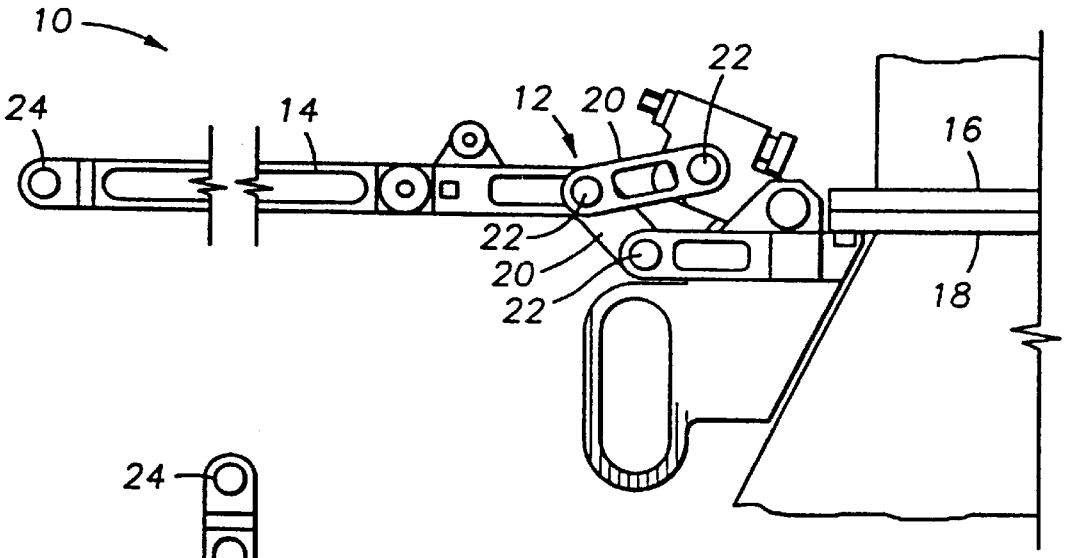
FIG. 1 (PRIOR ART)
FIG. 1 is a cross-sectional side view of a prior art toggle action clamp in the open position.

The present invention generally provides a clamp that is compact and lightweight, yet provides high holding strength and stiffness or rigidity. The clamp uses a unique double slant interface design which provides mechanical advantages to resist forces applied to the clamp members as the load increases. The clamp allows for rapid and remote-activated release of the clamp jaws by applying only a small operating force to an over-center lock/release mechanism, such as by pulling a manual tether.

The clamp incorporates first and second jaws having fulcrums that are pivotally coupled together. Adjacent ends of the two jaws are configured as workpiece contacting ends. A first jaw has a cantilever end extending generally opposite the workpiece contacting end and beyond the fulcrum. The second jaw has a third member pivotally coupled to the second jaw, preferably at a point adjacent the cantilever of the first jaw. The third member is a load bearing member that acts as a spacer or wedge to secure the first and second jaws in a rigid, fixed relationship by resisting compressive forces transmitted through the jaws from the workpiece.

A fourth member, such as a hook, is releasably disposed to retain the cantilever in contact with the third member. It is preferred to have the fourth member pivotally coupled to either the cantilever or the third member, most preferably the third member, in order to avoid having loose parts and to simplify the application of the clamp to a workpiece. The fourth member can be disposed to prevent the third member from being displaced from a position between the cantilever and the second jaw. In this closed or hooked position, the fourth member prevents the clamp from opening.

Once the clamp is assembled in place around a workpiece, a snug-down load is applied to the workpiece by the workpiece contacting ends of the jaws. It is preferable that at least one of the jaws include a threaded spindle bolt extending therethrough to form an adjustable workpiece contacting surface. It may also be preferred, according to specific applications, that the workpiece contacting end have workpiece contacting surfaces contoured to mate with, or otherwise accommodate, features of the workpiece. For example, a clamp being used to secure two flanges may include a jaw with a slot or cutout for placement over bolt heads or nuts.

Once the clamp applies a snug-down load, the clamp remains rigid and provides a high holding strength to the clamped workpiece(s) during the performance of some procedure on the workpiece, such as fastening or unfastening two workpieces. For example, the jaws may be used to clamp two flanges having O-rings or other gasketing material therebetween which produce a force against each workpiece contacting end of the jaws. Because the jaws are pivotally coupled at their fulcrums, these forces are transmitted as a rotational force through each jaw. The third member is positionable between the cantilever of the first jaw and the second jaw to resist or oppose these rotational forces. Once the procedure being performed on the workpiece is complete, the clamp is released by disengaging the fourth member, removing the third member from contact with the cantilever, and separating the workpiece contacting ends.

In one aspect of the invention, the cantilever of the first jaw has a first surface for contacting the third member and a second surface, opposed from the first surface, for contacting or receiving the fourth member. When the clamp is closed and a load is applied, the first surface and the third member are in facing contact under a compressive load. It is preferred that the contact between the first surface of the cantilever and the third member define an interface that is slanted relative to the rotational direction of the load. The slant is provided at such an angle that the load at the interface produces a compressive load and a kick load on the third member, wherein the kick load is a minor portion of the load on the third member. The compressive load is transmitted directly to the second jaw and the kick load is directed to swing the third member away from, and out of contact with, the cantilever. However, it may also be desirable to provide a slight interference fit between the third member and the second jaw to limit the extent of the swing.

The function of the fourth member is to resist or oppose the kick load and retain the third member in contact with the cantilever. It is preferred that the contact between the second surface of the cantilever and the fourth member define a second interface that is slanted relative to the direction of the kick load applied to the third member. This slanted interface is provided at such an angle that the load at the second interface, which is proportional to the kick load on the third member, produces a tensile load and a kick load on the fourth member, wherein the kick load is a minor portion of the load on the fourth member. The tensile load is transmitted directly to the second surface of the cantilever and the kick load is directed to swing the fourth member away from, and out of contact with, the cantilever.

The slope of the slanted interfaces is dependent on the finish of the contacting or load bearing surfaces. The clamp is preferably made of a high strength steel material, although it can be made of aluminum or other rigid materials known in the art depending on the magnitude of the load of application. It is generally preferred that both surfaces of each slanted interface be polished and coated (e.g., with solid film lubrication/Teflon coating/epoxy glass) to within a desired range of boundary friction. Once a surface finish or coating has been chosen and the corresponding ranges of friction determined, the slope or angle of the slanted interfaces that will produce a desired kick load can be easily determined and verified by simple tests.

Where the clamp of the present invention incorporates the two slanted interfaces described above, it is preferred that the clamp also incorporate a lock/release mechanism for resisting or opposing the kick load on the fourth member and releasably secure the fourth member in a closed position. The clamp is released by operating the lock/release mechanism, preferably by pulling a manual tether or cord connected to the lock/release mechanism. The amount of force required to release the clamp may be tailored to a specific application, as will be described below, and is preferably low enough for manual operation, most preferably below about 25 pounds of force.

In another aspect of the invention, the lock/release mechanism comprises an overcenter mechanism disposed between the fourth member and an arm extending from some other member of the clamp, preferably the third member. A preferred over-center mechanism is pivotally coupled at one end and includes a roller on the other end. The roller is received in a cradle by applying a locking force which pushes the roller past into a stable position just "over-center," i.e. just past the point of greatest resistance. It is preferred that the cradle include an adjustment device, such as a set screw, for limiting how many degrees over-center the roller is allowed to pass. Whereas any over-center angle greater than zero degrees may be used, it is preferred to limit the degrees over-center. Limiting the degrees over-center reduces the operating force necessary to release the over-center mechanism. It is further preferred that the cradle and set screw allow adjustment between about 1 and about 5 degrees over-center so that the operating force is less than the kick load on the fourth member. It is also preferred that the over-center mechanism be pivotally coupled to either the fourth member or an arm extending from the third member and engage a cradle formed in an opposed surface of either the third or fourth members, respectively.

Upon release of the lock/release mechanism, the kick loads cause the fourth and third members to automatically swing away from their engaged positions, thereby releasing the forces applied to the workpiece and allowing the jaws of the clamp to fully open. In fact, it is most preferred that the kick loads cause the fourth and third members to swing away with sufficient force that the jaws of the clamp are automatically pulled to a fully open position. An automatic and forced opening of the clamp facilitates remote releasing and withdrawal of the clamp. Furthermore, a fully open position, such as about 90 degrees, is necessary in some applications of the clamp, such as the docking of two space crafts, to allow an unobstructed separation of the workpieces.

In another aspect of the invention, the clamp is provided with an optional slide link assembly. The assembly is generally disposed between the third member and the first jaw so that the first jaw does not independently rotate about the fulcrum, thereby complicating the positioning of the clamp onto a workpiece. Furthermore, the assembly is designed so that the act of pivoting the third member towards the cantilever causes the first jaw to close onto the workpiece prior to the third member actually making contact with the cantilever. The slide link provides the benefit of positioning and closing the clamp onto a workpiece with a single hand.

The clamp of the present invention can be made very small and lightweight, yet rigid and strong. While a lightweight clamp is generally desirable in most applications, weight is a major consideration in space flight, particularly at higher orbital inclinations such as that used for the international space station. A preferred clamp of the present invention can be made weighing only 10 pounds, yet hold a load greater than 10,000 pounds. It should be recognized, however, that the clamp may be made having various sizes, weights and holding capacities depending upon the particular application. For example, it is believed that the clamp would be particularly beneficial in securing pipe or vessel flanges during welding, assembly or disassembly; truck or boat docking equipment; heavy machine work and assembly; temporary structures, barricades and bulkheads; and the like.

It may also be desirable to incorporate a plurality of clamping members along the length of a pair of common workpiece contacting plates. Each clamping member would operate independently except that the first and second jaws of each clamping member must move simultaneously. In this manner, the strength and rigidity of a plurality of clamping members may be provided over an enlarged area. In order for the jaws to open and closed smoothly or at all, the central fulcrums of each clamping member should have a common axis.

Figure 3:
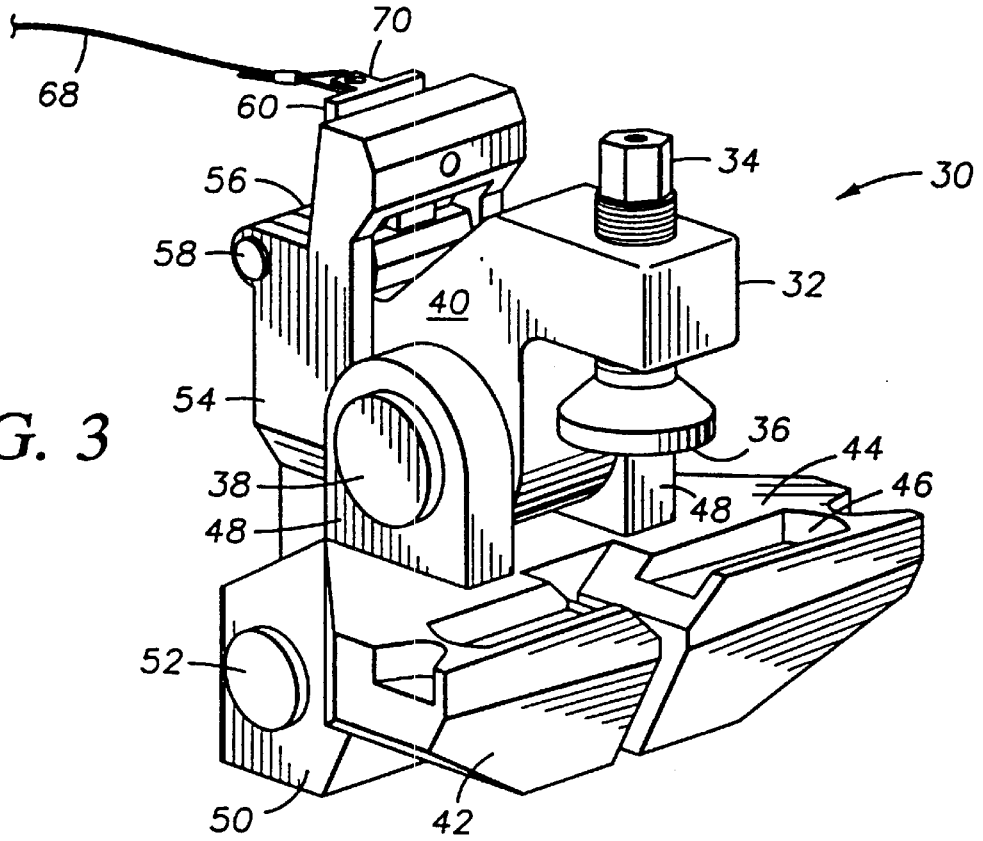
FIG. 3 is a front perspective view of a high strength clamp of the present invention.
Figure 4:
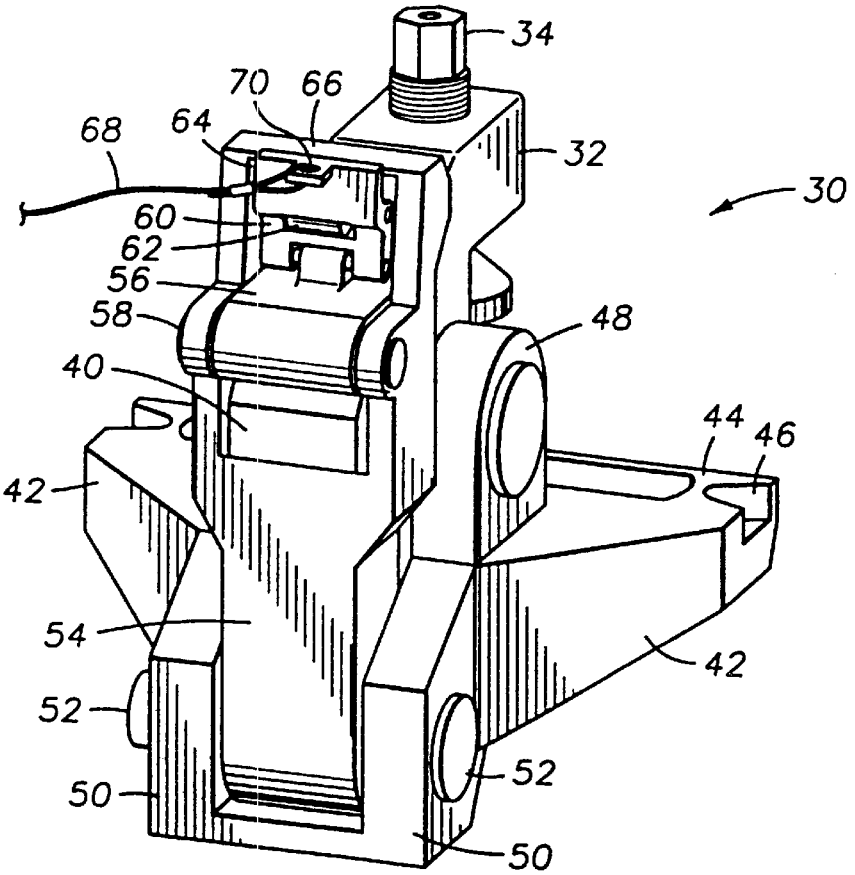
FIG. 4 is a back perspective view of the high strength clamp of FIG. 3.

Now referring to FIGS. 3 and 4, front and back perspective views of a high strength clamp 30 of the present invention are shown. The clamp 30 has a first member, hereinafter referred to as the first jaw 32, with a spindle bolt 34 extending therethrough to form a workpiece contacting surface 36, a fulcrum defined by a pin hole and pivot pin with flanged bushing 38, and a cantilever 40 extending generally opposite of the workpiece contacting end of the first jaw 32. A second member, hereinafter referred to as the second jaw 42, includes a workpiece contacting surface 44 with tailored cutouts 46 formed therein, a fulcrum defined by a pair of parallel lugs 48 receiving the fulcrum of the first jaw 32, and a pair of parallel lugs 50 with pivot pin and flanged bushings 52 for pivotally coupling with a third member or load rod 54.

The third member 54 includes a fourth member or hook 56 that is pivotally coupled thereto about a pivot pin with flanged bushings 58. The fourth member 56 engages the cantilever 40 to prevent the third member 54 from swinging away from the cantilever 40 (out of the page in FIG. 4). In turn, an over-center lock/release mechanism 60 is pivotally coupled to the fourth member 56 at the opposite end of the fourth member from the pivot. The lock/release mechanism 60 has a roller 62 (better shown in FIG. 5) which engages a cradle 64 formed in the arm portion 66 of the third member 54. The clamp 30 can be remotely released by applying an operating force to a tether line 68 coupled to the link 70 of the lock/release mechanism 60.

Figure 5:
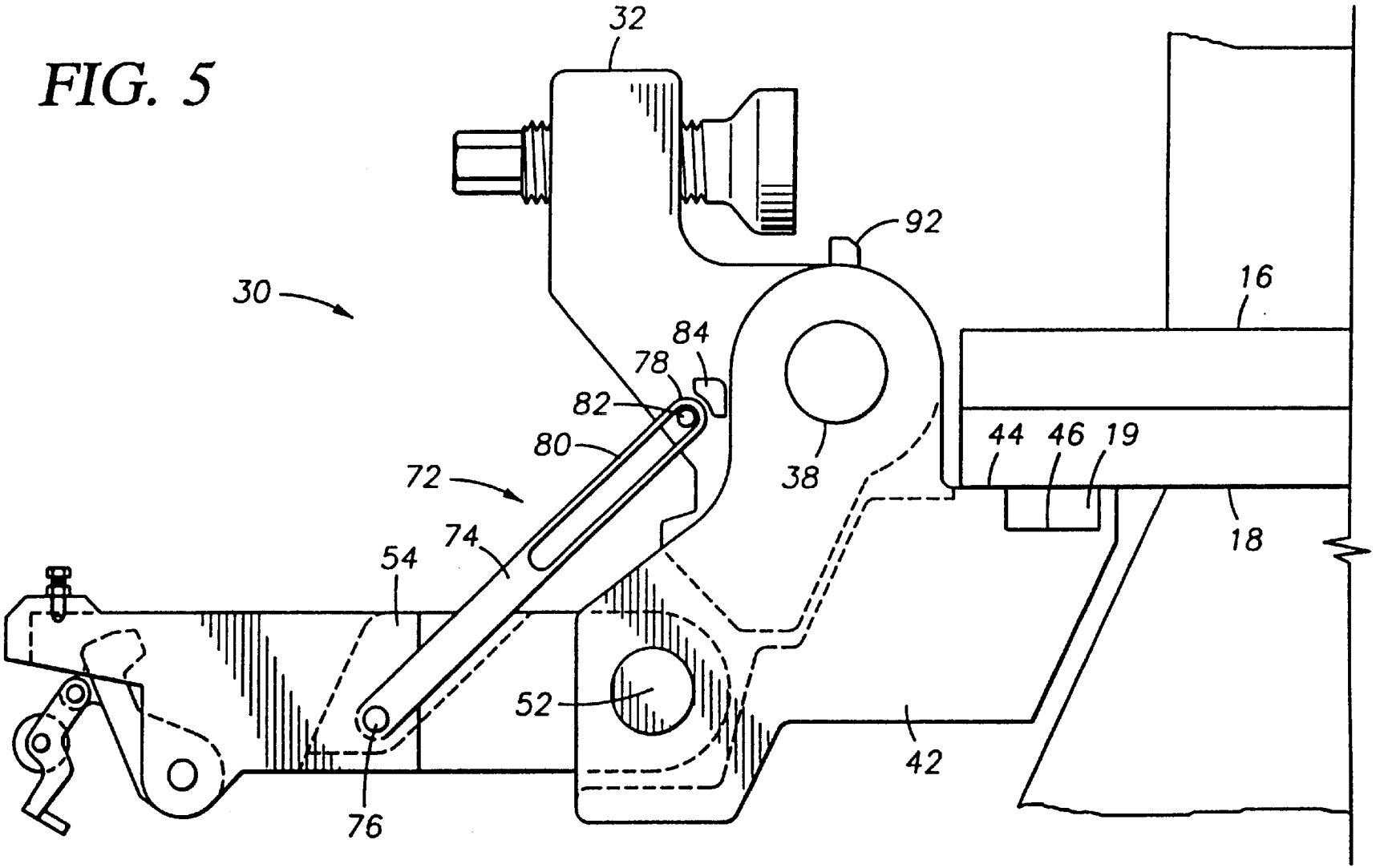
FIG. 5 is a side view of the high strength clamp of FIG. 3 in an open position and including an optional slide link assembly.
Figure 6:
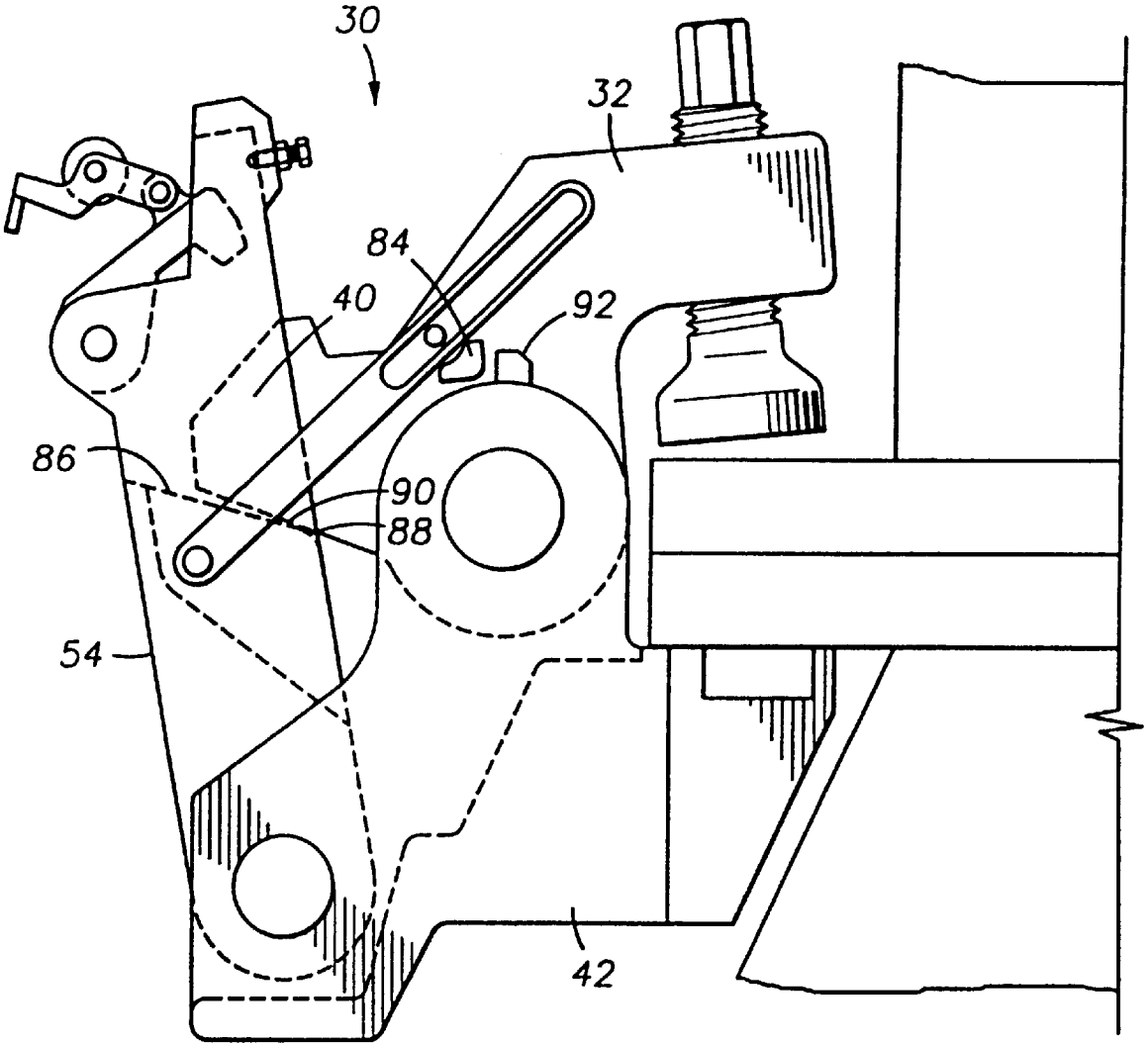
FIG. 6 is a partial cross-sectional side view of the high strength clamp of FIG. 5 in a partially closed position.
Figure 7:
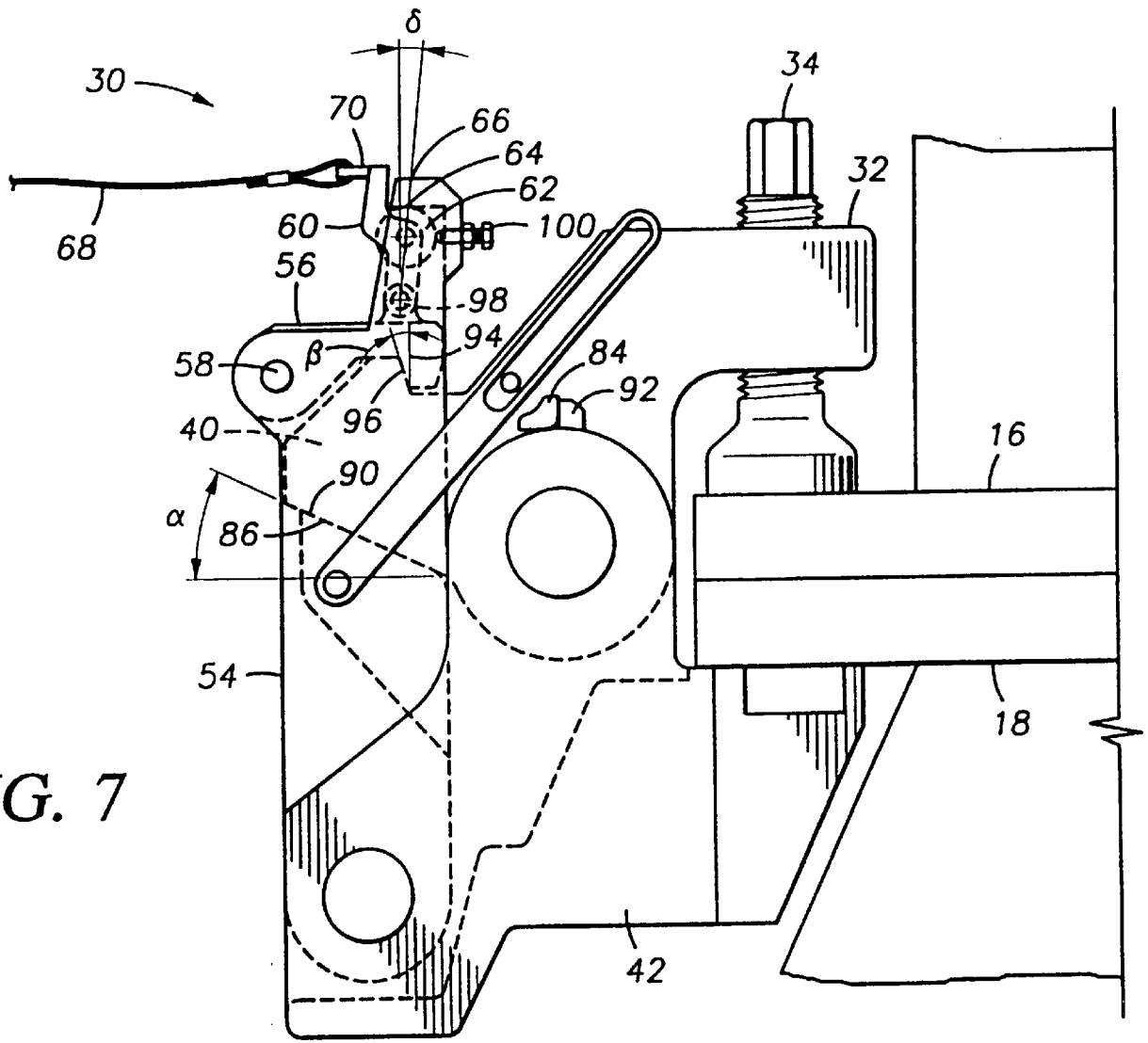
FIG. 7 is a partial cross-sectional side view of the high strength clamp of FIG. 6 in a fully closed position.

Now referring to FIGS. 5–7, partial cross-sectional side views of the high strength clamp 30 of FIG. 3 are shown in an open position, a partially closed position and a fully closed position, respectively, and including an optional slide link assembly 72. Referring specifically to FIG. 5, the clamp 30 is initially positioned for clamping the two flanges 16,18 by placing the workpiece handling surface 44 of the second jaw 42 on one side of the mating flanges. The cutout 46 receives the extruded nutplate or gusset 19 to allow the surface 44 to make direct and full contact with the flange 18.

The first jaw 32 and the third member 54 are both pivotally connected to and disposed relative to the second jaw 42 about substantially parallel axis defined by the pivot pin with bushings 38, and the pivot pin with bushings 52, respectively. The first jaw 32 and the third member 54 are additionally mutually coupled by an optional slide link assembly 72. The assembly 72 comprises a slide link 74 with a first end pivotally coupled to the third member 54 at a fixed pivot point 76. The second end 78 of the slide link 74 includes a guide pin track 80 that slidably engages a guide pin 82 which extends from one side of the first jaw 32. As the third member 54 is rotated towards the first jaw 32 (clockwise as shown in FIGS. 5–7), the slide link end 78 pushes against a guide member 84 extending from the side of the first jaw 32. The force placed on the guide member 84 is transmitted to the first jaw 32 and causes the jaw 32 to rotate towards the workpiece 16,18 (clockwise as shown in FIGS. 5–7).

Now referring primarily to FIG. 6, a partial cross-sectional side view of the high strength clamp 30 of FIG. 5 is shown in a partially closed position. Note that the slide link assembly is designed to cause sufficient rotation of the first jaw 32 to allow the slanted surface 86 of the third member 54 to make initial contact with the cantilever 40 at point 88. The slide link 74 is then allowed to pass around the guide member 84 causing no further rotation of the first jaw 32. It is the direct contact between the third member 54 and the first surface 90 of the cantilever 40 that causes the first jaw 32 to complete its rotation.

Now referring to FIG. 7, a partial cross-sectional side view of the high strength clamp 30 of FIG. 6 is shown in a fully closed position. It is preferred that the full rotation of the first jaw 32 be limited by a stop member 92 extending from the lug 48 of the second jaw 42. In this manner, rotation of the jaw 32 is completed when the guide member 84 of the first jaw 32 engages the stop member 92. It is also preferred that the guide member 84 and stop member 92 make contact prior to, or simultaneous with, the spindle bolt 34 making contact with the workpiece 16,18 so that the clamp 30 can be closed before applying a snug-down load. If desired, a higher and pre-determined torque load can be applied to the spindle bolt to produce a higher initial compressive pre-load on the workpiece.

With the clamp 30 in the closed position, the slanted surface or wedge portion 86 of the third member 54 is disposed in full contact with the first surface 90 of the cantilever 40. The fourth member or hook 56 is subsequently pivoted about pivot pin 58 until a slanted surface 94 of the fourth member 56 is disposed in contact with a second surface 96 of the cantilever 40.

Once the fourth member 56 is in full contact with the cantilever 40, the lock/release mechanism 60 can be rotated about pivot 98 (clockwise in FIGS. 5–7) with the force of a single finger until the roller 62 is received within the cradle 64 and travels at least one degree over-center. The exact number of degrees over-center that the mechanism 60 will travel is adjustable by turning a self-locking set screw 100 in threaded engagement through a portion of the arm 66. With the lock/release mechanism 60 in the locked position, the first and second jaws 32,42 are held in a rigid relationship. If desired, a safety pin can be easily incorporated for added security. The spindle bolt 34, with its threaded engagement through the first jaw 32, is then turned to apply a load on the workpiece 16,18.

In accordance with the present clamp design, as just described, the clamp 30 remains in this position, under very high loads, until the tether 68 is pulled by an operating force great enough to pull the roller 62 out of the cradle 64. However, even when the clamp 30 is under a load of about 10,000 pounds, the necessary operating force is only about 25 pounds. Note that upon release of the lock/release mechanism 60, the clamp 30 opens automatically in accordance with FIGS. 5–7 viewed sequentially in reverse.

Figure 8:
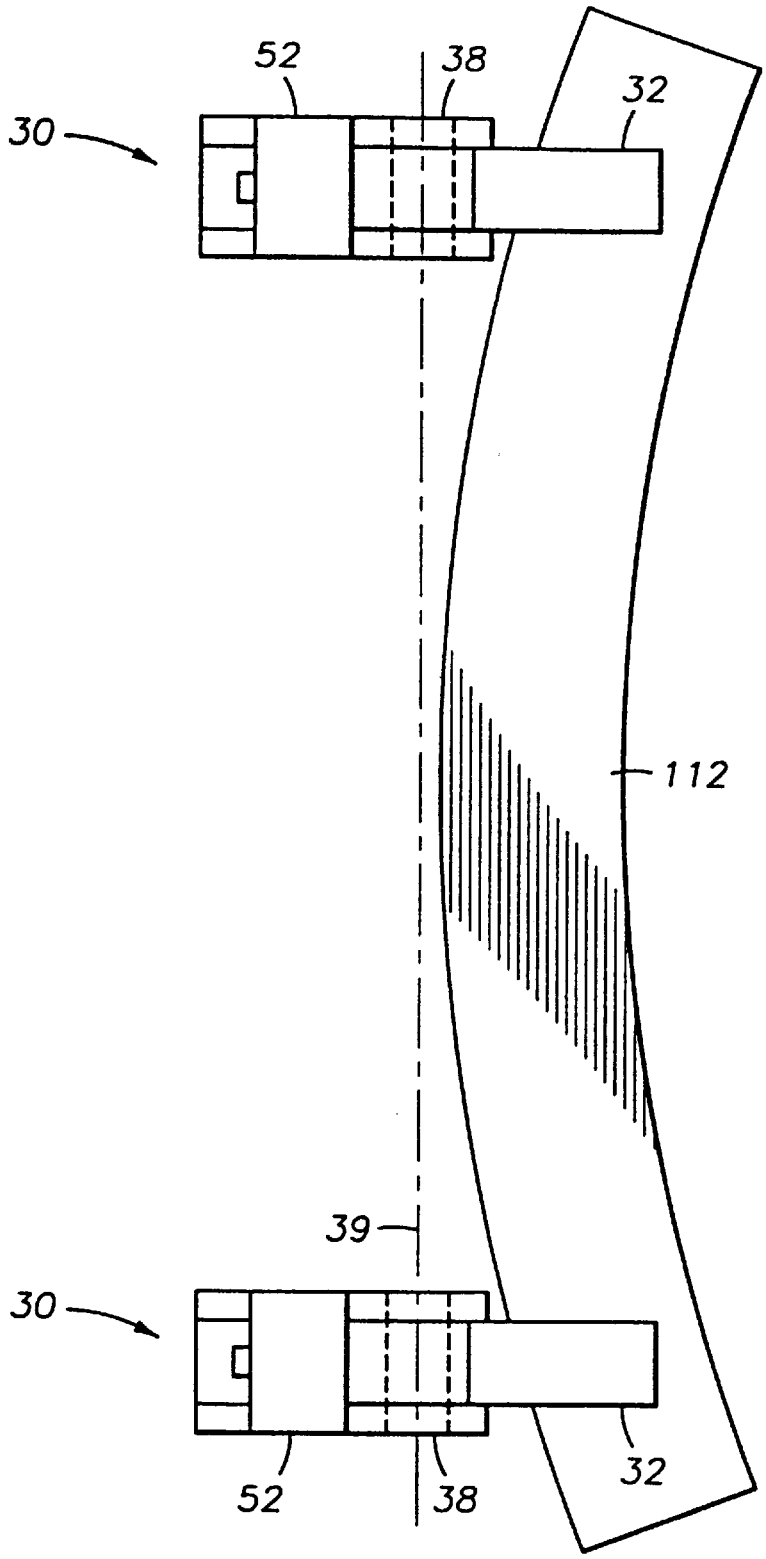
FIG. 8 is a top view of an apparatus incorporating two clamping members having common workpiece contacting plates.

Now referring to FIG. 8, two clamping members 30 are connected to and mutually spaced along the length of first and second curved workpiece contacting plates 112. The plates 112 may be designed in various shapes and sizes in accordance with a particular application, such as a flange having a particular diameter. A first, top plate 112 is coupled to the first jaw 32 of each clamping member, and a second, lower plate 112 (not shown) is coupled to the second jaw 42 (FIGS. 5–7). Other than the attachment of the plates 112, the clamping members 30 operate in an identical manner as the clamp of FIGS. 3–7. It should be noted that both clamping members 30 must be released before the jaws and plates may be opened. Additionally, since the clamping members 30 are rigidly coupled by the common plates, it is necessary for the central fulcrums of each clamping member to have a common axis so that the apparatus can open.

The clamps of the present invention incorporate multiple slanted interfaces making it possible to channel a relatively small and pre-determined portion of a high clamp load into the release mechanism. The slanted interfaces allow the channeled load to be exponentially reduced, while maintaining a sufficiently steep slant angle to assure a positive kick load that will open the clamp on command. Unlike the previously discussed prior art toggle action clamp, in which the joint friction always resists the handle operation force, the present clamp is far less sensitive to the joint friction. The joint friction in the main load path of the clamp actually helps to reduce the release load. At release, the slanted interfaces allow a complete and quick severance of the load paths. Therefore, the components of the clamp can be as short and compact as possible resulting in a truly optimized design with minimum weight and maximized stiffness. The over-center lock/release mechanism of the clamp allows the clamp to be unlocked while still under a full load. The lock/release mechanism preferably includes a roller which assures that the release mechanism is less sensitive to the friction. The set screw allows the over-center angle to be adjustable so that the corresponding release load can be fine-tuned.

This invention is particularly useful for the assembly and disassembly of various highly loaded gasketed joints. It is also useful as a high-capability, quick-and-remote-release clamp for a variety of applications, especially in hazardous environments like outer space, pipeline repair and construction, fire fighting or demolition. The invention may also be found useful in more common applications, such as quick release C-clamps, jigs or fixtures. Furthermore, the invention is useful in any application where it is desired to have improved mechanical advantages, higher load carrying capability and less volume and weight.

Figure 2:
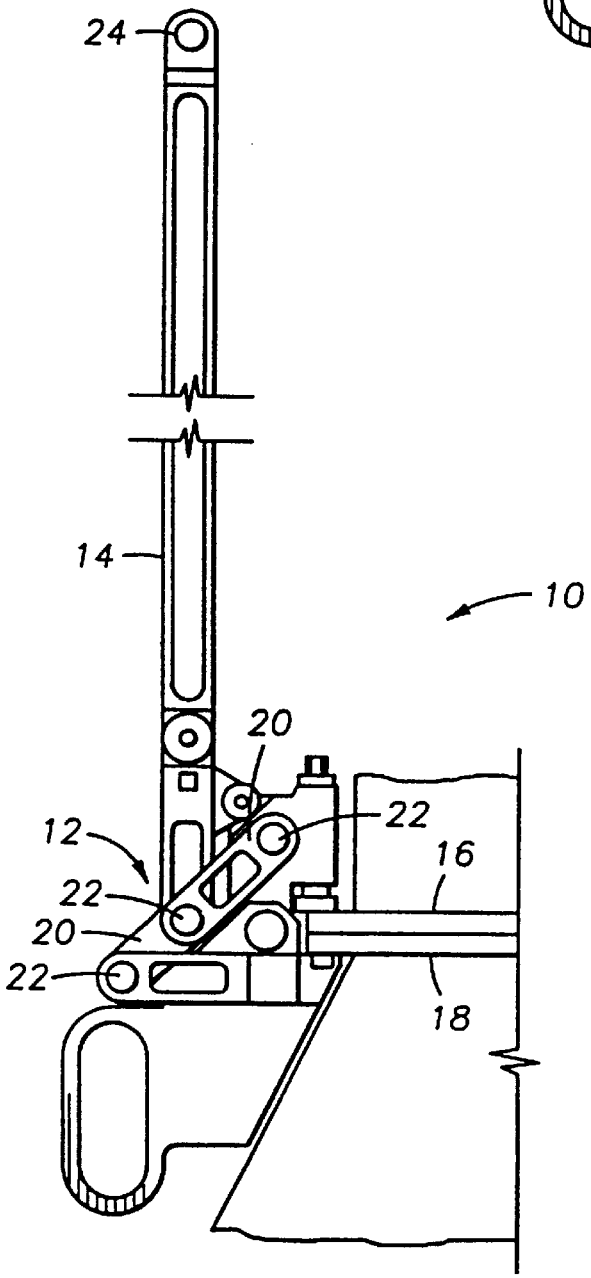
FIG. 2 (PRIOR ART)
FIG. 2 is a cross-sectional side view of the prior art toggle action clamp of FIG. 1 in the closed position to secure two flanged members.

As an example, a clamp may be prepared in accordance with FIGS. 3–7 for application in NASA's Orbiter Docking System (ODS), having a 96-bolt interface contingency demating apparatus operable to releasably connect the Space Shuttle to the Russian MIR, or the International Space Station. The clamp preferably is tested along side a prior art clamp, constructed in accordance with FIGS. 1–2.

The maximum length of the assembled clamp, including the handle mount, may be only twelve inches, i.e., far shorter and lighter than the 32-inch handle necessary to actuate the prior art clamp. The main body of the clamp was less than 6 inches in width and was capable of carrying an ultimate load greater than 30,000 pounds. The clamp was found to be strong, stiff and lightweight. The total weight of the clamp was less than 10 pounds, compared with the 22-pound prior art clamp. Because two clamps are required for the contingency demating procedure, the present clamps provide a total weight saving of 24 pounds for each Orbiter flight. The clamp also required less space for storage and operation.

The operating force of the present clamp was measured at less than 25 pounds with a 10,000 pound load in the clamp. The prior art clamp required a 35 pound operating force with only 5,700 pound load in the clamp. When the load on the prior art clamp approached 10,000 pounds, a winch tool and additional procedures were required for the release. The present clamp required none of these additional procedure and no pre-flight calibration or maintenance.

The operating force of the prior art clamp using a conventional toggle action mechanism was adjustable only to a degree because it was sensitive to the joint friction. The operating force of the present clamp was easily adjusted to a desirable low level, making it truly remotely releasable and user friendly. When high loads were applied to the prior art clamp, a major portion of the operating force was devoted just to overcome the joint friction. By contrast, the clamp of the present invention was far less sensitive to the joint friction under the same or greater loads.

While the foregoing is directed to a preferred embodiment of the present invention, other and further embodiments of the invention may be devised without departing from the basic scope thereof. The scope of the invention is determined by the claims which follow.

What is claimed is:

1. A clamp comprising: a first jaw having a workpiece contacting end, a central fulcrum, and a cantilever element;

a second jaw having a workpiece contacting end and a central fulcrum coupled to the central fulcrum of the first jaw;

a third member pivotally coupled to the second jaw, the third member being disposed to contact the cantilever element of the first jaw; and a hook disposed between the third member and the cantilever element to retain the cantilever in contact with the third member.

2. The clamp of claim 1, further comprising an over-center mechanism engaging the fourth member.

3. The clamp of claim 1, further comprising a slide link assembly disposed between the third member and the first jaw.

4. The clamp of claim 1, further comprising a spindle bolt extendible from one of the jaws to contact the workpiece.

5. The clamp of claim 1, wherein the third member has a wedge portion disposed to contact the cantilever element of the first jaw.

6. The clamp of claim 1, wherein the fourth member is a hook.

7. The clamp of claim 6, further comprising a lock member for releasably securing the hook in contact with the cantilever element.

8. The clamp of claim 1, wherein a portion of the third member is rigidly disposed between the first and second jaws.

9. A clamp, comprising:

a first jaw having a workpiece contacting end, a central fulcrum, and a cantilever element having first and second opposed surfaces;

a second jaw having a workpiece contacting end and a central fulcrum coupled to the central fulcrum of the first jaw;

a third member pivotally coupled to the second jaw about a first axis, the third member is disposed to contact the first opposed surface of the cantilever element along a first interface, wherein the first interface forms an outwardly opening angle with a line tangent to the first axis; and a fourth member pivotally coupled to the third member about a second axis, the fourth member disposed to contact the second opposed surface of the cantilever element along a second interface, wherein the second interface forms an outwardly opening angle with a line tangent to the second axis.

10. The clamp of claim 9, wherein a load applied between the first and second jaws transmits a first kick load to the third member.

11. The clamp of claim 10, wherein the first kick load transmits a smaller, second kick load to the fourth member, and further comprising a locking member to releasably oppose the second kick load.

12. The clamp of claim 9, wherein the third member has a wedge portion disposed to contact the first opposed surface, wherein the fourth member has a wedge portion disposed to contact the second opposed surface, and further comprising a locking member to releasably secure the wedge portion of the fourth member in contact with the second opposed surface.

13. The clamp of claim 12, wherein the locking member comprises an over-center mechanism.

14. The clamp of claim 9, further comprising a slide link assembly disposed between the third member and the first jaw.

15. The clamp of claim 9, further comprising a spindle bolt disposed through a jaw to contact the workpiece.

16. A clamp, comprising:

a first jaw having a workpiece contacting end, a central fulcrum, and a cantilever element having a load transmitting surface;

a second jaw having a workpiece contacting end and a central fulcrum coupled to the central fulcrum of the first jaw;

a load bearing member pivotally coupled to the second jaw, the load bearing member displaceably disposed to contact the load transmitting surface of the cantilever element; and a hook pivotally coupled to the load bearing member, the hook displaceably disposed to secure the load bearing member in contact with the load transmitting surface.

17. The clamp of claim 16, further comprising a lock pivotally coupled to the load bearing member.

18. The clamp of claim 17, wherein the lock comprises an over-center mechanism.

19. The clamp of claim 18, wherein the over-center mechanism engages an arm of the load bearing member.

20. The clamp of claim 19, wherein the over-center mechanism comprising a roller which engages the arm.

21. The clamp of claim 20, the over-center mechanism having a pivotal mounting permitting it to be pivoted beyond an over-center position further comprising a set screw disposed to the arm for adjusting the permitted pivotal movement of the over-center mechanism beyond its over-center position.

22. An apparatus comprising:

(a) a plurality of clamping members, each clamping member comprising:

(i) a first jaw having a clamping end, a central fulcrum, and a cantilever element;

(ii) a second jaw having a clamping end and a central fulcrum coupled to the central fulcrum of the first jaw element;

(iii) a third member pivotally coupled to the second jaw, the third member disposed to contact the cantilever of the first jaw; and (iv) a hook disposed between the third member and the cantilever element to retain the cantilever element in contact with the third member;

(b) a first workpiece contacting plate coupled to the clamping end of the first jaw of each clamping member; and (c) a second workpiece contacting plate coupled to the clamping end of the second jaw of each clamping member, wherein the central fulcrums of each clamping member have a common axis.

* * * * *